United States Patent [19]

Jones

[11] 4,383,511

[45] May 17, 1983

[54] CONTROL SYSTEM

[75] Inventor: Christopher Jones, Alcester, England

[73] Assignee: Lucas Industries Limited, Birmingham, England

[21] Appl. No.: 231,419

[22] Filed: Feb. 4, 1981

[30] Foreign Application Priority Data

Feb. 19, 1980 [GB] United Kingdom ..... 8005550

[51] Int. Cl.[3] ..... F02D 1/12

[52] U.S. Cl. ..... 123/359; 123/198 D

[58] Field of Search ..... 123/357, 358, 359, 198 D

[56] References Cited

U.S. PATENT DOCUMENTS 3,795,826 3/1974 Adey ..... 123/357 X
3,897,762 8/1975 Jones et al. ..... 123/357 X
3,898,969 8/1975 Williams et al. ..... 123/357
3,973,539 8/1976 Jones et al. ..... 123/359 X
4,242,728 12/1980 Hartford ..... 123/480 X

*Primary Examiner*—Tony M. Argenbright

[57] ABSTRACT

A control system for the fuel pump of an internal combustion engine includes a fuel determining network which controls the conduction of an output transistor by way of an input transistor. A transducer provides an operator demand signal to the network. In the event of failure of the network the transducer is arranged to control the supply of base circuit to the output transistor so that the conduction of the output transistor is directly controlled. The output transistor controls the flow of current in the winding of an actuator for the control member of the fuel pump.

7 Claims, 3 Drawing Figures

CONTROL SYSTEM

This invention relates to a control system for the fuel pump of an internal combustion engine and of the kind comprising an electromagnetic actuator operable to determine the amount of fuel supplied by the pump, a control circuit including an output stage for controlling electric current flow in the actuator and a fuel determining network which controls the output stage and a transducer operable by the operator of the engine for supplying a demand signal to the fuel determining network.

With such a system the possibility exists of a failure in the fuel determining network and the network is designed so that the failure is safe. As a result upon failure, the pump ceases to supply fuel to the engine. In the case where the engine is a vehicle engine this means that the vehicle is stranded.

The object of the present invention is to provide a control system in a form in which the output stage can be arranged to supply a limited current to the actuator to enable the engine to be started and the vehicle driven at a reduced speed.

According to the invention the demand transducer is operable independently of the fuel determining network to provide a signal to the output stage to cause a flow of electric current in the actuator.

One example of a control system in accordance with the invention will now be described with reference to the accompanying drawings in which.

Figure 1:
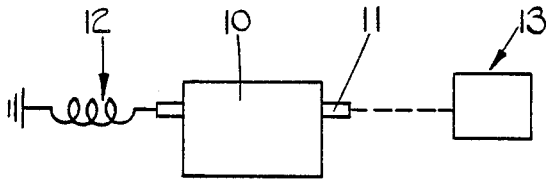
FIG. 1 is a diagrammatic representation of the fuel pump.
Figure 2:
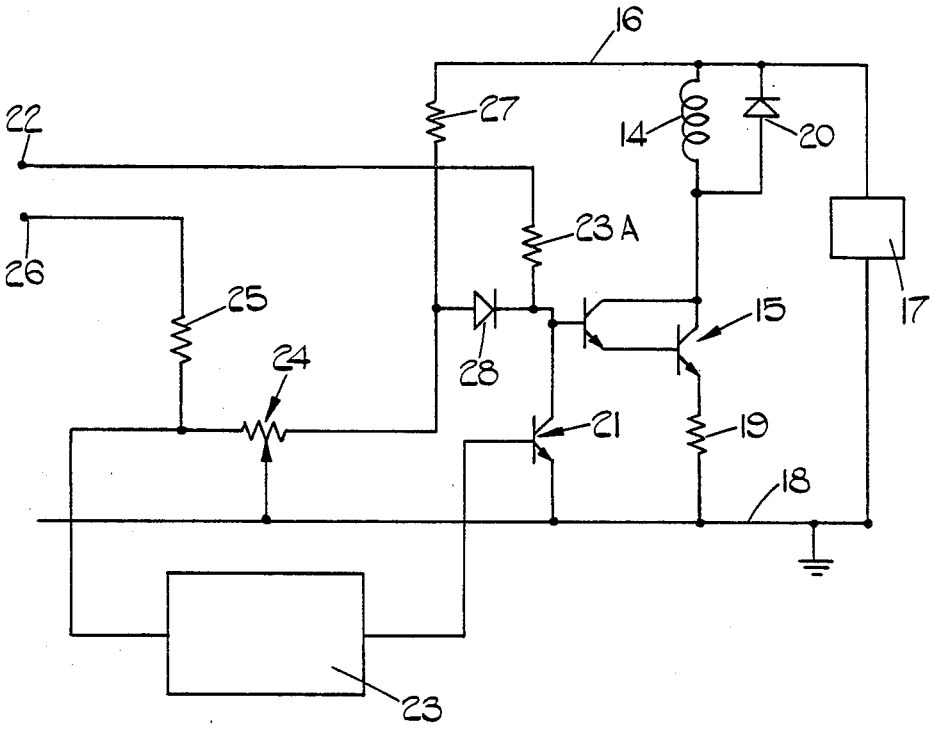
FIG. 2 is a circuit diagram of the control system.

Referring to FIG. 1 of the drawings there is provided a fuel pump 10 which is operated in timed relationship with the associated engine and which includes a fuel control member 11 which is axially movable to determine the amount of fuel delivered by the pump. A coiled tension spring 12 is provided and which biasses the control member 11 to the zero fuel position against the action of an electromagnetic actuator 13 the operating coil of which is supplied with current by the control system. The actuator may be of any convenient type but it includes a winding 14 shown in FIG. 2. As the current flow in the winding is increased so the fuel pump delivers more fuel and when the current flow ceases the spring 12 moves the control rod 11 to the position of zero fuel.

The control circuit includes an output stage which comprises a pair of transistors 15 connected as a Darlington pair, the common collectors of which are connected to one end of the winding 14 the other end of which is connected of a power line 16 connected to one terminal of the vehicle battery 17. The other terminal of the battery is connected to an earth line 18. The emitter of the second transistor of the Darlington pair, is connected by way of a resistor 19 to the supply line 18. Moreover, in parallel with the winding 14 is a fly wheel diode 20.

The base of the first transistor of the Darlington pair 15 is connected to the supply line 18 by way of the collector emitter path of a transistor 21 and also to a supply terminal 22 by way of a resistor 23A. The conduction of the transistor 21 is controlled by a fuel determining network 23 which for the sake of simplicity is shown in block form. The network 23 determines the amount of fuel which should be supplied to the associated engine by the fuel pump in accordance with various signals which are supplied to it one such signal being the speed of the associated engine, and another signal being a demand signal which is provided by a pedal transducer 24 the setting of which is controlled by the driver of the vehicle. The network 23 ensures that the speed of the associated engine shall not exceed a predetermined value as well as taking into account various other desired engine operating perameters.

The transducer 24 is in the form of a potentiometer the slide of which is connected to the supply line 18. One end of the resistance element of the potentiometer is connected by way of a resistor 25 to a further supply terminal 26 and the junction of the resistor 25 and the resistance element of the potentiometer is connected to the fuel determining network 23. As the slider is moved so the signal applied to the network will vary. The network controls the on/off period of the transistor 21. When the transistor 21 is conducting no base current is supplied to the first transistor of the Darlington pair and hence both transistors are not conducting and no current flows in the winding 14. If however the transistor 21 ceases to conduct then base current is supplied to the first transistor of the Darlington pair by way of a resistor 23A and both transistors of the Darlington pair conduct so that current flows in the winding 14 of the actuator. As a result the control rod 11 is moved to a position to ensure supply of fuel to the engine. When the control network causes transistor 21 to conduct then the transistors forming the Darlington pair cease to conduct and the current flow in the winding decays slowly by virture of the diode 20. The mean current flow in the winding 14 can therefore be controlled by varying the on/off period of the transistor 21.

The terminals 22 and 26 are connected to a stabilised power supply which of course derives its power from the supply lines 16, 18. In the event of a fault in the network, fault detection circuits in the network will switch off the aforesaid stabilised power supply and no current will flow in the winding 14. Examples of the fuel determining network are seen in the specifications of British Pat. Nos. 1429304 and 1429772.

In order to enable the engine to be started and the vehicle driven, a resistor 27 is connected between the supply line 16 and the other end of the resistance element of the potentiometer 24 forming the pedal transducer. Moreover, a diode 28 is connected between the base of the first transistor of the Darlington pair and the junction of the resistor 27 and the resistance element of the potentiometer, the diode having its cathode connected to the base of the first transistor of the Darlington pair.

In operation, assuming that the voltage at the terminals 22 and 26 is zero due to a fault condition having been detected or a failure, current can flow to the base of the first transistor of the Darlington pair by way of the diode 28, the current being derived from the potentiometer network comprising resistor 27 and a portion of the potentiometer forming the pedal transducer 24. The value of the resistor 27 is chosen so that the current which can flow is limited. In this situation the transistors forming the Darlington pair are not switched as is the case when the circuit is functioning as described above and the value of the resistor 27 is chosen that only a limited current can flow and hence a limited fuel delivery obtained from the fuel pump. This is necessary in order to limit the maximum speed of the engine so that it cannot exceed the safe value. The resistor 27, the diode 28 and the aforesaid portion of the potentiometer which forms the pedal transducer 24 do not affect the normal operation of the circuit. This is because when the transistor 21 is conducting it carries the current flowing in the resistor 23A and any current from the network comprising the resistor 27, the aforesaid portion of the potentiometer and the diode 28. When the transistor 21 is not conducting the sum of these currents turns the first transistor of the Darlington pair on as described. The diode 28 acts to allow conduction of the first transistor of the Darlington pair in the event that the slider of the potentiometer forming the transducer 24 is at the extreme right hand end that is to say when the opposite ends of the resistor 27 are effectively connected to the lines 16 and 18. In this situation the diode is reverse biased. The resistor 19 provides negative feed back which acts to extend the range of control provided by the pedal transducer during emergency operation.

Figure 3:
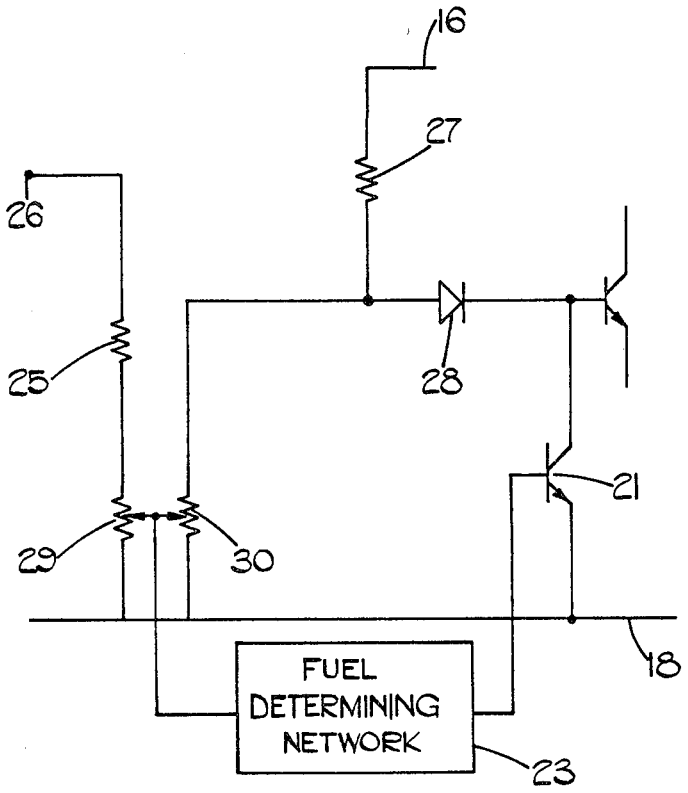
FIG. 3 shows a modification of the circuit diagram of FIG. 1.

In the event of failure of the network 23 then control of the current flow in the actuator will automatically pass to the additional components of the circuit. It may however be convenient to incorporate an emergency switch in series with the resistor 27 and which must be operated by the driver of the vehicle to effect emergency operation. As shown, the transducer 24 comprises a potentiometer. A similar effect can be produced as shown in FIG. 3, in which the resistor 25 is connected through the resistance element of one variable resistor 29 to the supply line 18 and the resistor 27 is connected to the supply 18 through the resistance element of a further variable resistor 30. The sliders of the two resistors are connected together and to the fuel determining network 23.

An alternative arrangement is to utlize a potentiometer and to connect its resistance element in series with the resistor 27 and the supply line 18. The anode of the diode 28 is connected to the slider of the potentiometer instead of to the junction of the resistance element and the resistor 27 and in addition the slider is connected to the fuel determining network 23. Provision is made in the network to take care of the fact that the signal to the network varies in the opposite sense as compared with the arrangement described with reference to FIG. 2. Moreover, switch means must be provided if it is required that no signal should be provided to the network in the event of a fault in view of the fact that resistor 25 is no longer required.

I claim:

1. A control system for the fuel pump of an internal combustion engine and of the kind comprising an electromagnetic actuator operable to determine the amount of fuel supplied by the pump, a control circuit including an output stage for controlling electric current flow in the actuator and a fuel determining network which controls the output stage, a demand transducer operable by the operator of the engine for supplying a demand signal to the fuel determining network, said output stage including an output transistor, a first resistor through which base current can be supplied to said output transistor to cause conduction thereof, current flow through said first resistor being cut off in the event that a failure or fault occurs in the fuel determining network, an input transistor the conduction of which is controlled by said fuel determining network, said input transistor acting to control the supply of base current to said output transistor, a potentiometer chain having a tapping connected to the base of said output transistor, said demand transducer forming a component of said potentiometer chain whereby when a failure of fault occurs in the fuel determining network, base current will be supplied to the output transistor under the direct control of the demand transducer.

2. A control system according to claim 1 in which said component comprises a potentiometer, the slider of which constitutes said tapping.

3. A control system according to claim 1 in which said component comprises a variable resistor, said tapping being from a fixed point in the potentiometer chain.

4. A control system according to claim 3 including a further variable resistor forming part of said demand transducer, said further variable resistor forming part of a further potentiometer chain, having a tapping at which is available said demand signal.

5. A control system according to claim 4 in which said variable resistors are defined by a potentiometer the slider of which is connected to one terminal of a source of electric supply.

6. A control system according to claim 2 or claim 3 including a diode connected between the tapping and the base of said output transistor, said diode being connected so as be reverse biased to prevent flow of current from said first resistor to the potentiometer chain.

7. A control system according to claim 6 in which said input transistor has its collector-emitter path connected to the base of said output transistor to divert the current flowing in said first resistor when the input transistor is in a conductive state.

* * * * *